United States Patent [19]

Rattai

[11] Patent Number: 4,826,170

[45] Date of Patent: May 2, 1989

[54] LIAR'S DICE BOX

[75] Inventor: Herman Rattai, Winnipeg, Canada

[73] Assignee: Overman Enterprises Inc., Winnipeg, Canada

[21] Appl. No.: 157,233

[22] Filed: Feb. 18, 1988

[30] Foreign Application Priority Data

Feb. 23, 1987 [CA] Canada ..... 530320

[51] Int. Cl.[4] ..... A63F 9/04

[52] U.S. Cl. ..... 273/145 R; 273/145 C

[58] Field of Search ..... 273/145 R, 145 A, 145 B, 273/145 C, 145 CA, 145 D, 145 E, 146, 144 B

[56] References Cited

U.S. PATENT DOCUMENTS 954,070 4/1910 Zschau .
1,216,850 2/1917 Schrader .
1,223,507 4/1917 Mathias .
2,296,001 9/1942 Slattery .
2,724,595 11/1955 Amann ..... 273/145 A
2,823,036 2/1958 Worth .
4,095,796 6/1978 Monson .

FOREIGN PATENT DOCUMENTS 353523 5/1922 Fed. Rep. of Germany .
397356 5/1909 France .

*Primary Examiner*—Edward K. Look
*Attorney, Agent, or Firm*—Karen M. Gerken; Martin P. Hoffman; Mitchell B. Wasson

[57] ABSTRACT

In the game of Liar's Dice, a unique gaming box is used including a first closed compartment, a second shaking compartment, and a third holding compartment. The first closed compartment has a number of dice permanently sealed therein, such that when the box is shaken a continuous rattling of dice is audible. This allows a player to taken any of the active dice in the shaking compartment and place them in the holding compartment. When the box is shaken, the other players cannot audibly discern how many of the active dice are being shaken at one time.

4 Claims, 2 Drawing Sheets

LIAR'S DICE BOX

DESCRIPTION OF THE INVENTION

This invention relates to gaming boxes, and more particularly o a gaming box for playing the game of Liar's or Pirate's Dice.

DESCRIPTION OF THE PRIOR ART

Gaming boxes are known in the art. There are various U.S. patents for these boxes. For instance, U.S. Pat. No. 2,724,595, describe and claims a dice box with a pivotal cover and a plexiglass bottom portion, which prevents the dice from changing value. Another U.S. Pat. No. 2,296,001, discloses and claims a dice agitation box with a dice display area at one end of the box. It is arranged to display several of the dice when they come to rest at the bottom of the container while excluding the other. There is therefore a viewing area and an active or shaking chamber.

BACKGROUND OF THE INVENTION

The game of Liar's Dice requires a dice agitation gaming box with a holding compartment, and a gaming or shaking compartment. The necessity of having two compartments allows a player to put a number of dice, the value of which he wishes to keep, in the holding compartment while shaking the other dice. It is necessary that the other players do not view the dice that the player has shaken, so a covered lid is used to exclude the other players from viewing the dice. In this manner, players may sell their hand to another player who decides whether the seller is telling the truth or not. Boxes of these types, although not patented, are known in the art. A problem with a box of this type is that a skillful player knows by the sound of the dice how many dice are being shaken in the active compartment and how many dice are being held for their previous value in the holding compartment.

It is therefore an object of the present invention to provide a dice gaming box for use in the game of Pirate's or Liar's Dice constructed such that the players cannot discern how many dice are in the shaking area and how many dice are in the holding area, when a player shakes the box.

SUMMARY OF THE INVENTION

Therefore, this invention provides for a gaming box for playing Liar's Dice or other similar dice games comprising: a container with a moveable lid including a closed compartment; a shaking compartment; and a holding compartment, wherein when said lid is in a closed position, dice in said holding compartment do not change value.

In a preferred embodiment of the invention a gaming box has the closed compartment located in the lower portion of the container, and the second shaking compartment located above the sealed compartment on one side of it. The shaking compartment is accessible to the players when the lid is open. The holding compartment lies adjacent to the shaking compartment and also above the first sealed compartment. The holding compartment is also accessible to the players when the lid is opened. In the closed compartment are placed a number of dice, approximately five in number, which are permanently placed therein. These dice however are free to move about and make the noise of rattling dice when the box is shaken. The holding compartment is designed in such a manner that when the dice are placed therein, the lid is closed, and the box is shaken, the lid holds the dice against the bottom of the holding chamber so that the dice therein do not change their upward face value.

The box is generally constructed of wood, but may be constructed of any suitable material, and the shaking and holding compartments are lined with some type of material such as felt or velour to reduce the noise of the rattling dice.

The game for which the gaming box of the present invention can be successfully used is as follows. The game is for two or more players. The object of the game is to bluff or tell untruths at the appropriate time and try to ascertain the untruths of the opponents. The exposure of an untruth counts as one lie, and the first player to reach seven lies loses the game. If more than two play the game, the player reaching three lies must retire from the game. To start the game each player shakes the box, and the highest hand starts the game. The rank of dice hands are as follows: five of a kind, four of a kind, full house, high straight, low straight, three of a kind, two pairs, and one pair.

The player appointed to start the game must shake the box sufficiently to roll the dice. He must not expose the dice to anyone. After viewing the dice, he must close the box. He then tries to sell the hand to the next player. He can sell it for what he actually has, for less than he has, or for more than he has. The next player must buy the hand unseen or call the seller a liar. If the buyer is confident he is being oversold, he should call the seller a liar. If the buyer is correct, the seller loses. If the seller offered the sale correctly, or undersold the sale, the seller wins. If the second player buys the hand, he then can view his purchase. He must sell a higher hand to the next player. He may take any number or all of the dice and place them unchanged into the upper holding chamber where they will not roll or change face value. He then shakes the box to effect a roll. He may or may not view his dice and tries to sell it to the next player.

The use of the closed compartment with the noisy dice rattling therein greatly enhances the chance element of the game. For example, when a player shakes one of the prior art dice boxes and has all of the previous hand placed in the holding compartment, the players are well aware that there is no change in the hand, and with their knowledge of the previous hand, can defeat the object of the game. The present device has overcome this flaw in that none of the players can discern how many of the dice are in the holding area, and how many of the dice are in the shaking area.

BRIEF DESCRIPTION OF THE DRAWINGS

The present invention will be more fully described in conjunction with the following drawings, wherein.

DETAILED DESCRIPTION OF THE DRAWINGS

Figure 1:
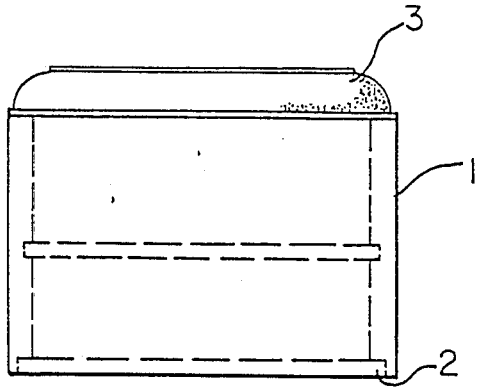
FIG. 1 is a side view of the dice box of the present invention.
Figure 2:
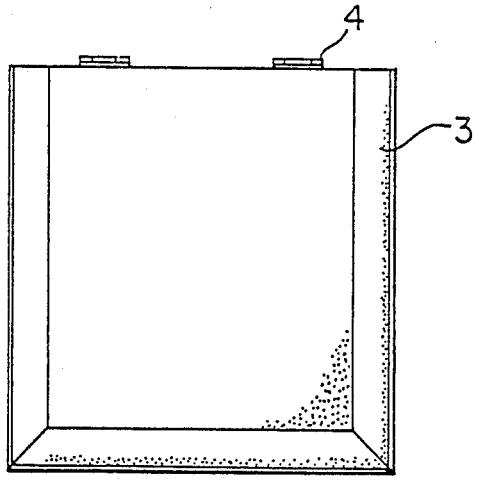
FIG. 2 is a top view of the box of the present invention.
Figure 3:
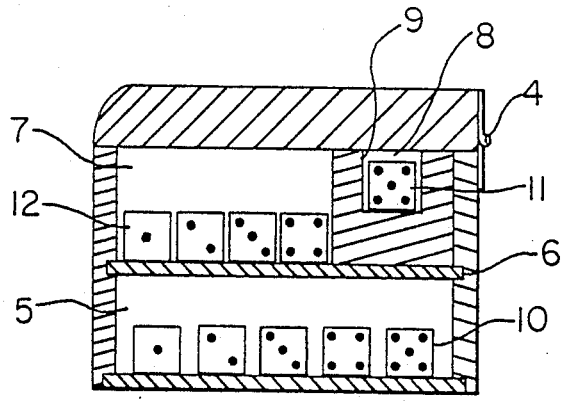
FIG. 3 is a cross section of the dice box of the present invention.

FIG. 1 of the dice box consists of a four sided container 1 having a bottom 2 and a top 3. In FIG. 2 one notes that the top 3 is fixed to the container 1 by hinges 4. In FIG. 3, the lower closed compartment 5 is divided from the remainder of the box by a partition 6. Above the closed compartment 5 is located a holding compartment 8, and an active or shaking compartment 7. When the lid is closed, dice from compartments 5, 7 and 8 are prohibited from transferring from one compartment to the other. Moreover, when the lid 3 is closed the value of the die 11 in the holding compartment 8 will not change face value, as there is insufficient room for the dice to roll. In FIG. 3 one notes that there are a number of dice 10 located permanently in the closed compartment 5. These dice, when the box is shaken, are free to move about and rattle. There are also four dice 12 located in the gaming compartment, and 1 die 11 in the holding compartment.

In operation, the player shakes the box and the dice in the gaming compartment 7 will likely change value. While the die 11 in the holding compartment 8 remains the same. The player, after shaking, may or may not view the hand in the gaming or shaking compartment 7 and then sell the box to another player who purchases and views the hand. He may or may not transfer one or more dice into the holding compartment 8. He then shakes the remaining dice in the gaming compartment 8 and the game continues until a winner is declared.

What I claim as my invention is:

1. A gaming box for playing Liar's Dice or other similar dice games comprising a container defined by a bottom wall, a plurality of side walls, and an open top end, a movable lid for closing off said open top of said container, said movable lid being adapted to assume an open position wherein said open top of said container is unobstructed, and a closed position wherein said lid closes off said open top, a partition provided in said container located above and spaced from said bottom wall so as to define a closed compartment in the bottom end of said container, said closed compartment being adapted to permanently receive a first plurality of dice, said closed compartment having a vertical depth as measured between said partition and said bottom wall sufficient to allow said first plurality of dice to freely move when said container is shaken, a shaking compartment defined between said partition and said top of said container, a holding compartment defined between said partition and said top of said container, said holding compartment being disposed adjacent said shaking compartment and separated therefrom, said shaking compartment being adapted to receive a second plurality of dice, said shaking compartment having a vertical depth as measured from said top of said container to said partition sufficient to allow said second plurality of dice to freely move when said container is shaken, said holding compartment being adapted to receive at least one die, said holding compartment having a vertical depth as measured from said top of said container toward said partition so as to prohibit rotation of said at least one die when said lid is in said closed position.

2. The gaming box recited in claim 1 wherein said lid is secured by hinge means with respect to said top of said container.

3. The gaming box recited in claim 1 wherein said shaking compartment and said holding compartment are accessible from said top of said container when said lid is in said open position.

4. The gaming box recited in claim 1 wherein said bottom, said side walls and said lid are constructed of wood, and said closed, shaking, and holding compartments are lined with a noise-reducing material.

* * * * *